US011519169B2

(12) United States Patent
Picchio

(10) Patent No.: US 11,519,169 B2
(45) Date of Patent: Dec. 6, 2022

(54) MODULAR PANELED PARTITION WALL

(71) Applicant: UNIFOR S.P.A., Turate (IT)

(72) Inventor: Cesare Picchio, Turate (IT)

(73) Assignee: UNIFOR S.P.A., Turate (IT)

( * ) Notice: Subject to any disclaimer, the term of this patent is extended or adjusted under 35 U.S.C. 154(b) by 0 days.

(21) Appl. No.: 17/286,793

(22) PCT Filed: Oct. 18, 2019

(86) PCT No.: PCT/IB2019/058905
§ 371 (c)(1),
(2) Date: Apr. 19, 2021

(87) PCT Pub. No.: WO2020/079659
PCT Pub. Date: Apr. 23, 2020

(65) Prior Publication Data

US 2021/0363750 A1 Nov. 25, 2021

(30) Foreign Application Priority Data

Oct. 19, 2018 (IT) ..... 102018000009597

(51) Int. Cl.
*E04B 2/82* (2006.01)
*E04B 2/74* (2006.01)

(52) U.S. Cl.
CPC ..... *E04B 2/821* (2013.01); *E04B 2/7401* (2013.01); *E04B 2002/7492* (2013.01)

(58) Field of Classification Search
CPC ..... E04B 2/821; E04B 2/825; E04B 2/7401; E04B 2002/7492; E04B 2002/7462; E04B 2002/7464; E06B 3/305
See application file for complete search history.

(56) References Cited

U.S. PATENT DOCUMENTS 3,364,641 A * 1/1968 Brenneman ..... E04B 2/821 52/573.1
4,103,463 A * 8/1978 Dixon ..... E05D 15/0613 52/143

(Continued)

FOREIGN PATENT DOCUMENTS

DE 1097648 B * 1/1961
DE 19829783 A1 1/2000

(Continued)

OTHER PUBLICATIONS

International Search Report, issued in PCT/IB2019/058905, dated Jan. 15, 2020, Rijswijk, Netherlands.

(Continued)

*Primary Examiner* — Christine T Cajilig
(74) *Attorney, Agent, or Firm* — Ferguson Case Orr Paterson

(57) ABSTRACT

A modular paneled partition includes a first pane panel defining a first panel bottom edge, a first panel upper edge, and a first panel thickness; a second pane panel defining a second panel bottom edge, a second panel upper edge, and a second panel thickness; a wall bottom edge structure including a fixed profile and a movable profile supporting the first and second pane panels and engaged with the fixed profile along an adjustment direction, and means for adjusting position of the movable profile, the movable profile defining a first and a second outer longitudinal sides, and a third side between the first and second outer longitudinal sides. The movable profile has a first bottom channel accommodating the first panel bottom edge, and a second bottom channel accommodating the second panel bottom edge.

15 Claims, 3 Drawing Sheets

(56) References Cited

U.S. PATENT DOCUMENTS

| | | | | |
|---|---|---|---|---|
| 2016/0356039 | A1* | 12/2016 | Del Missier | E04B 2/7448 |
| 2019/0218774 | A1* | 7/2019 | Danesi | E04B 2/7401 |

FOREIGN PATENT DOCUMENTS

| | | | | |
|---|---|---|---|---|
| EP | 3401488 | A1 * | 11/2018 | E04B 2/72 |
| GB | 2520925 | A * | 6/2015 | E04B 2/7401 |
| GB | 2520925 | A | 6/2015 | |
| WO | 2017126860 | A2 | 7/2017 | |

OTHER PUBLICATIONS

Written Opinion issued in PCT/IB2019/058905, dated Jan. 15, 2020, Rijswijk, Netherlands.

* cited by examiner

MODULAR PANELED PARTITION WALL

CROSS-REFERENCE TO RELATED APPLICATIONS

This application is a National Phase Application of PCT International Application No. PCT/IB2019/058905, having an International Filing Date of Oct. 18, 2019 which claims the benefit of and priority to Italian Patent Application No. 102018000009597, filed Oct. 19, 2018, each of which is hereby incorporated by reference in its entirety.

FIELD OF THE INVENTION

The present invention relates to a modular paneled partition wall, in particular having glass panes or another pane material.

BACKGROUND OF THE INVENTION

Dividing a large working or living environment into a plurality of smaller environments by means of modular paneled partition walls which are mounted on site according to a desired plan is known.

Using transparent or translucent glass panes as panels, mounted on borders or frames which surround such panes is also known. Thereby, the environments are brightened and seem a space greater than what they really are.

Due to the fragility of the glass, the background art tends to incorporate the edges of the panes into bulky and sturdy borders, which cover both the edge of the panels as well as part of the side surfaces of the panels themselves as much as possible, so as to protect them from impacts.

This known solution, however, is not free of disadvantages, in fact, the appearance of such walls is heavy, with bulky and sharp-cornered borders at sight.

High-quality design, on the other hand, requires the creation of modular pane partition walls, in particular made of glass, with a clean, linear and light appearance, reducing the visible part of the borders, and possibly making such borders not visible.

This requirement is in contrast with the fragile nature of the fragile pane panels, in particular when made of glass. Furthermore, the most critical areas of fragile panes, for example made of glass, are the edges, since, generally, the cracks are formed at the edges and move more or less rapidly towards the inside of the pane, sometimes entirely running through it and requiring the replacement thereof.

In order to reduce the visible part of the borders, it is not sufficient to reduce the size thereof, since this would cause a reduction in safety when mounting and using such partition walls, making them hardly stable and very fragile.

The need is therefore felt to provide a modular pane paneled partition wall, for example having panes made of glass or of another fragile material, capable of ensuring a high level of safety both during mounting and use, and at the same time capable of making the borders hardly visible, or substantially invisible.

SUMMARY OF THE INVENTION

It is an object of the present invention to devise and provide a modular pane paneled partition wall, for example having glass panes or a different fragile material panes, which allows to satisfy the aforesaid requirements and to obviate at least partially the drawbacks complained here above with reference to the background art.

In particular, it is an object of the present invention to provide a modular pane paneled wall, for example having glass panes, capable of ensuring a high level of safety both during mounting and use, and at the same time capable of making the borders which outline said wall hardly visible, or substantially invisible.

These and further objects and advantages are achieved by a modular paneled partition wall has described and claimed herein.

Further objects, solutions and advantages are shown in the embodiments described below and claimed in the dependent claims.

BRIEF DESCRIPTION OF THE DRAWINGS

The invention will be illustrated below with the description of some embodiments thereof, given by way of explanation and not by way of limitation, with reference to the accompanying drawings in which.

DESCRIPTION OF THE PREFERRED EMBODIMENTS

Figure 3:
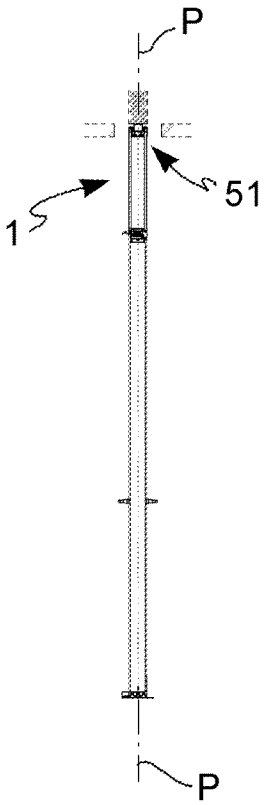
FIG. 3 shows a sectional view of the partition wall of FIG. 1, on a vertical section plane III passing through a door in the partition wall.
Figure 2:
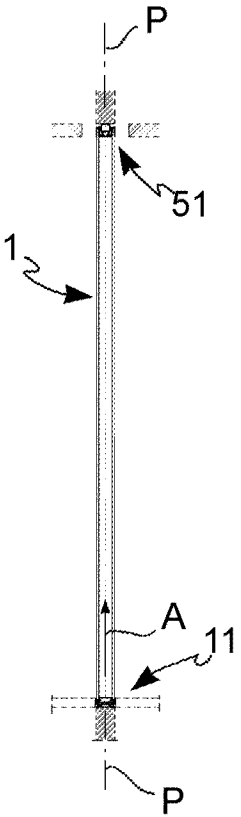
FIG. 2 shows a sectional view of the partition wall of FIG. 1, on a vertical section plane II.
Figure 1:
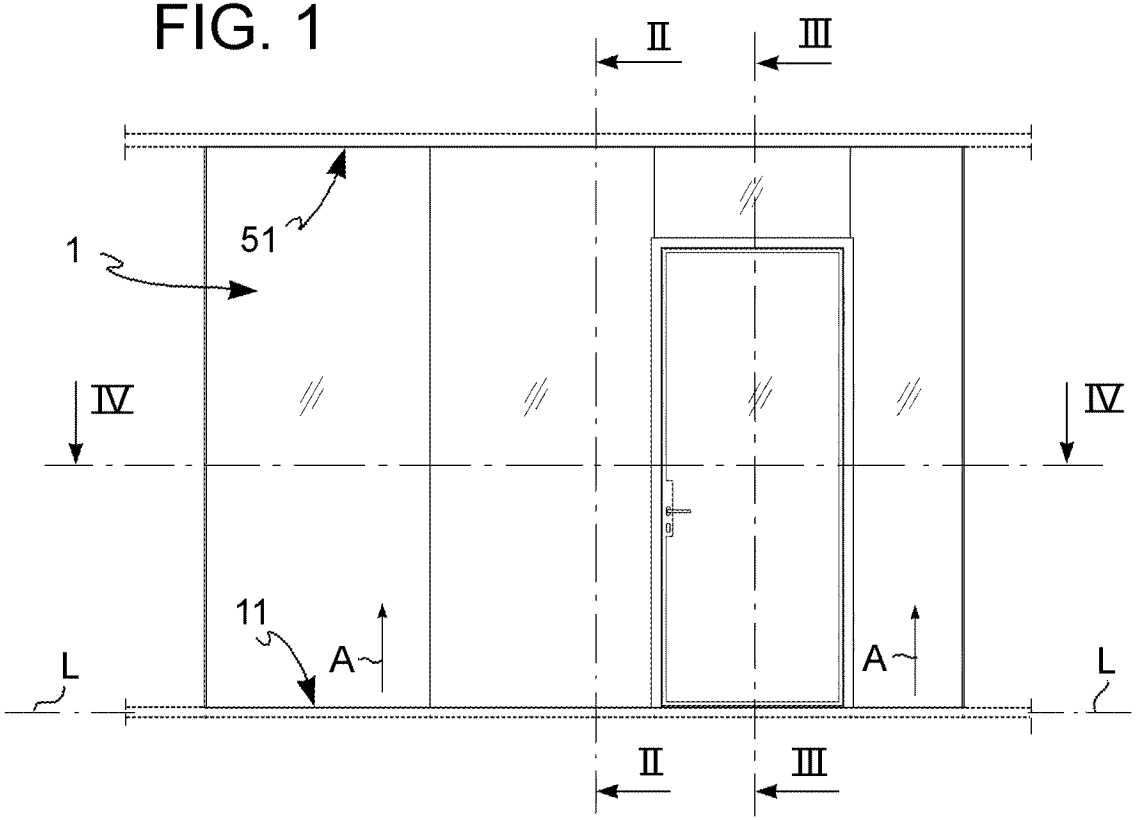
FIG. 1 shows a front view of a modular partition wall made of glass panes in accordance with the invention.
Figure 4:
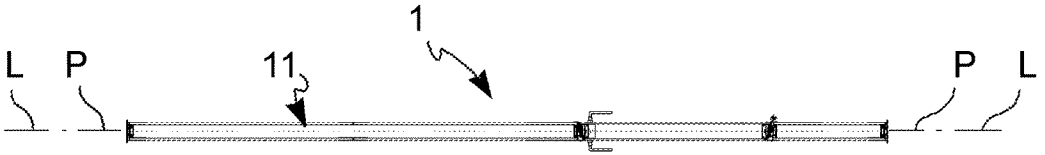
FIG. 4 shows a sectional view of the partition wall of FIG. 1, on a horizontal section plane IV.

With reference to the Figures, a modular paneled partition wall in accordance with the invention is generally indicated with reference numeral 1.

The partition wall 1 defines a wall plane P-P arranged along a main median extension plane of such wall.

The partition wall 1 comprises a first pane panel 101, for example made of glass, parallel to the wall plane P-P, defining a first panel bottom edge 103, an opposite first panel upper edge 104, a first panel thickness S1, and a second pane panel 102, for example made of glass, parallel to the wall plane P-P, defining a second panel bottom edge 105, an opposite second panel upper edge 106, and a second panel thickness S2.

With "pane panel" is intended to means a panel made of a fragile material, for example, made of glass of any color, for example transparent or satin, or made of marble, or stone, or artificial marble of the Corian® type, or another similar material.

In accordance with an embodiment, the first panel 101 and the second panel 102 are flat panels, and, preferably, the first panel thickness S1 is equal to, or substantially equal to, the second panel thickness S2. Preferably, the first panel thickness S1 and/or the second panel thickness S2 is comprised between 8 mm and 16 mm, even more preferably is about 13 mm, even more preferably is 12.76 mm.

In accordance with an embodiment, the first panel 101 and/or the second panel 102 are formed by two glass panes each, stuck to each other along respective surfaces facing and in contact with each other.

In accordance with an embodiment, the first panel 101 and the second panel 102 comprise laminated glass panes with low iron content.

In accordance with an embodiment, the first panel upper edge 104 and the first panel bottom edge 103 are straight edges, preferably parallel to each other.

In accordance with an embodiment, the second panel upper edge 106 and the second panel bottom edge 105 are straight edges, preferably parallel to each other.

In accordance with an embodiment, the first panel 101, defines a first panel height measured between the first panel bottom edge 103 and the first panel upper edge 104, and the second panel 102 defines a second panel height measured between the first panel bottom edge 105 and the second panel upper edge 106, wherein the first panel height is equal to the second panel height.

The wall 1 has a wall bottom edge structure 11 surrounding the first panel 103 and second panel 105 bottom edge.

The wall bottom edge structure 11 comprises a fixed profile 21 adapted to be fixed to a floor, and a movable profile 22 defining a movable profile axis L, and adapted to support the first panel 101 and the second panel 102, wherein the movable profile 22 is parallel to the fixed profile 21 and slidably engaged with the fixed profile 21 along a predetermined adjustment direction A belonging to the wall plane P-P, preferably orthogonal to the movable profile axis L, adjusting means 16 for adjusting the position of the movable profile 22 with respect to the fixed profile 21 according to the predetermined adjustment direction A.

The movable profile 22 defines a first outer longitudinal side 14 of said wall bottom edge structure 11 at least partially parallel to the wall plane P-P, an opposite second outer longitudinal side 15 of said wall bottom edge structure 11 at least partially parallel to the wall plane P-P, a third side 19 arranged between said first outer longitudinal side 14 and said second outer longitudinal side 15, facing the inside of the wall 1 towards a upper edge structure 51, which will be described below.

The movable profile 22 comprises a first bottom channel 12 configured to accommodate the first panel bottom edge 103, and a second bottom channel 13 configured to accommodate the second panel bottom edge 105, the first bottom channel 12 and the second bottom channel 13 extending from the third side 19 and being parallel to each other and to the wall plane P-P and arranged in the proximity of the first outer longitudinal side 14 and of the second longitudinal side 15, respectively.

In accordance with an embodiment, the wall bottom edge structure 11 comprises a finishing profile 70 interposed between the first bottom channel 12 and the second bottom channel 13, having a size such as to entirely cover said third side 19 between the first bottom channel 12 and the second bottom channel 13.

The finishing profile 70 may comprise coupling means for coupling with the third side 19, for example, into seats 29 obtained in said third side 19.

In accordance with an embodiment, the finishing profile 70 has a flat finishing surface 71 exposed towards the inside of the wall, said flat finishing surface 71 being arranged orthogonal to the wall plane P-P and parallel to the movable profile axis L.

In accordance with an embodiment, the flat finishing surface 71 comprises a graphical pattern equal to, or substantially equal to, a graphical pattern of a floor plane 200. In accordance with an embodiment, the movable profile 22 is an extruded profile, preferably made of metal, for example aluminum, or is an extruded profile made of a polymeric material, for example plastic.

In accordance with an embodiment, the fixed profile 21 is an extruded profile, preferably made of metal, for example aluminum, or is an extruded profile of a polymeric material, for example plastic.

The modular partition wall 1 comprises a wall upper edge structure 51 arranged along the wall plane P-P, comprising a first upper channel 52 configured to accommodate said first panel upper edge 104, and a second upper channel 53 configured to accommodate said second panel upper edge 106, said first upper channel 52 and said second upper channel 53 being parallel to the wall plane P-P.

The wall upper edge structure 51 comprises sliding means to allow the sliding of the first panel upper edge 104 and of the second panel upper edge 106, according to the adjustment direction A.

The modular paneled wall 1 comprises a first aluminum gasket profile 17, interposed between the first bottom channel 12 and the first panel bottom edge 103, and a second aluminum gasket profile 18, interposed between the second bottom channel 13 and the second panel bottom edge 105.

Such a first aluminum gasket profile 17 and second aluminum gasket profile substantially resist undeformed to the weight of the pane panel, which generally has a rather high specific weight, but at the same time they adapt to the surface of the first bottom edge and of the second bottom edge of the pane panels, protecting them not only from impacts during installation, but also from concentrated loads which would be applied to discrete points of such surface in the case of even microscopic surface irregularities, from which dangerous cracks may be triggered, which would advance into the pane leading it towards brittle fracture.

In accordance with an embodiment, the first bottom channel 12 and the second bottom channel 13 have a shape specular to each other with respect to the wall plane P-P, and the first gasket profile 17 and the second gasket profile 18 have an equal shape with respect to each other, or have a shape specular to each other with respect to the wall plane P-P.

In accordance with an embodiment, the movable profile 22 has a cross section having a shape symmetrical, or specular, with respect to the wall plane P-P.

In accordance with an embodiment, the fixed profile 21 has a cross section having a shape symmetrical, or specular, with respect to the wall plane P-P.

Preferably, both the movable profile 22 and the fixed profile 21 have respective cross sections symmetrical with respect to the wall plane P-P.

In accordance with an embodiment, the first gasket profile 17 is shaped to adhere both to the first panel bottom edge 103 and to the first bottom channel 12, and the second gasket profile 18 is shaped to adhere both to the second panel bottom edge 105 and to the second bottom channel 13.

Figure 5:
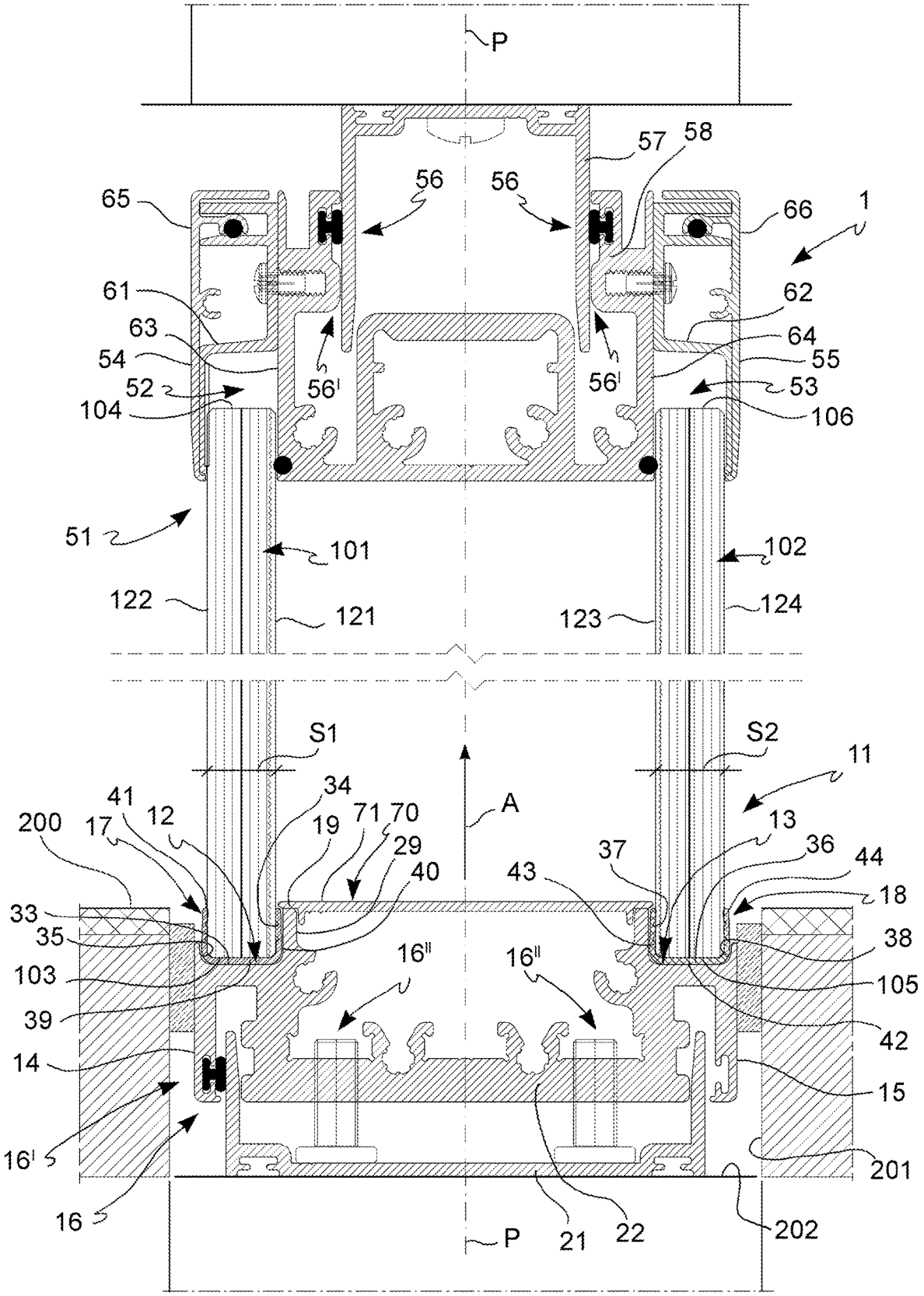
FIG. 5 shows a sectional view of an enlarged detail of FIG. 2, according to a first embodiment of the invention.
Figure 6:
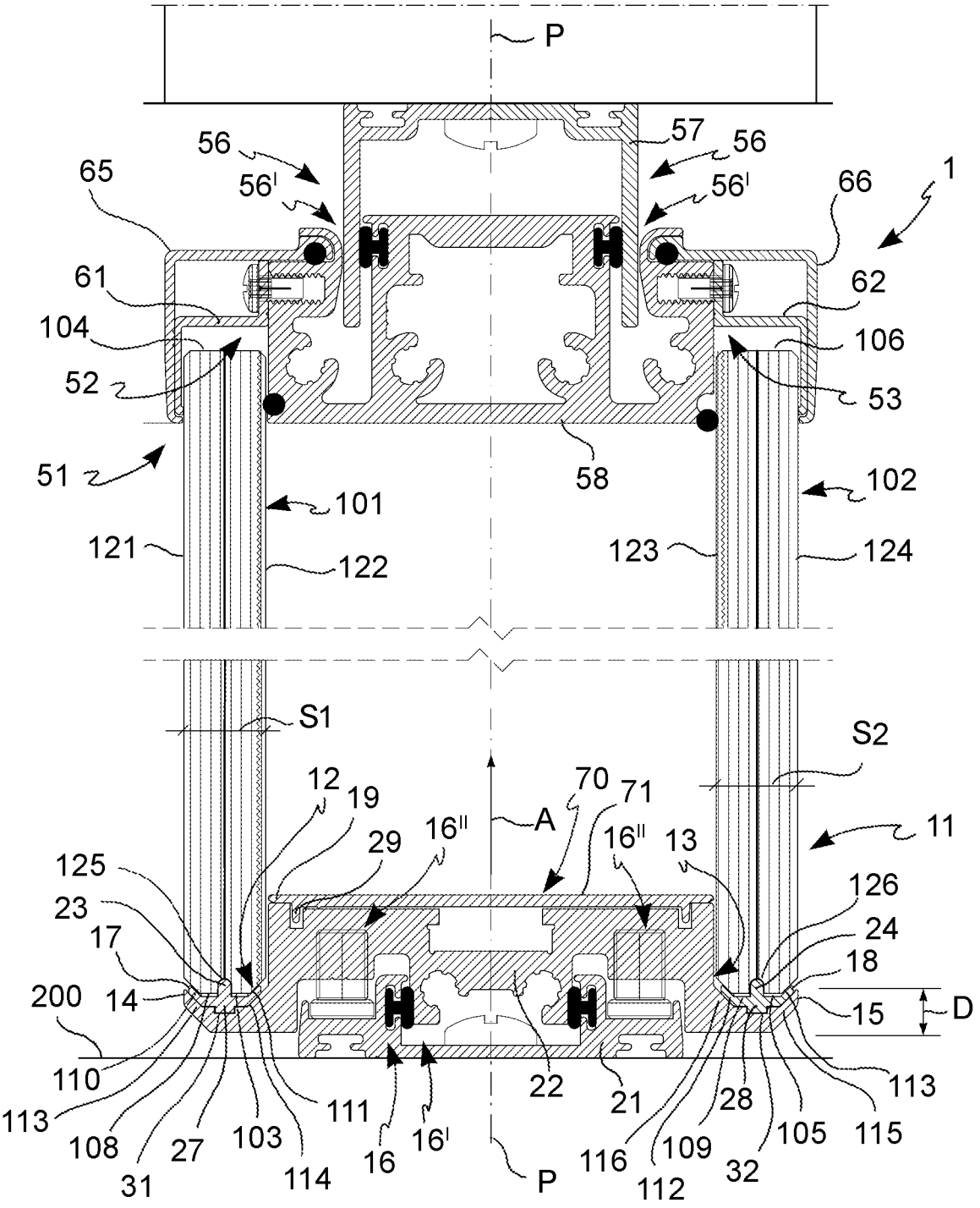
FIG. 6 shows a sectional view of an enlarged detail of FIG. 2, according to a second embodiment of the invention.

In accordance with an embodiment, each of said first bottom channel 12 and said second bottom channel 13 has a channel side which is at least partially open, preferably only partially open as shown in FIGS. 5 and 6, towards the outside of said wall 1, on opposite parts with respect to the wall plane P-P.

Thereby, the bottom edge structure 11, while ensuring a safe mounting of the panels, is, in use, hardly visible or not visible when the wall 1 is viewed frontally from one of the faces of the panels 101 or 102.

For example, in the case of the embodiment shown in section in FIG. 5, the bottom edge structure 11 is configured to remain hidden below the floor plane 200. The movable profile 22 has a side of the channel 12 at least partially open towards the outside of the wall 1. Also, the gasket profile 17 remains hidden below the floor plane 200.

In accordance with an embodiment, for example shown in FIG. 5 or in FIG. 6, the first outer longitudinal side 14 of the bottom edge structure 11 and the second longitudinal side 15 of the bottom edge structure form a respective side end prominence configured for preventing the first panel 101 and the second panel 102 from disengaging from the seat 12 and 13 thereof.

Said side end prominence inferiorly delimits and defines said only partially open side.

At the same time, the side end prominence prevents the panel 101 from disengaging from the seat 12 thereof.

According to an embodiment, as for example shown in FIGS. 5 and 6, the side end prominence has cross section substantially shaped as a hook, or as a claw.

The gasket profile of FIGS. 5 and 6 also allows to protect the bottom edge of the panel 101 during the transport and/or the mounting.

In particular, the position of the movable profile 22 may be adjusted according to the adjustment direction A, so that the flat finishing surface 71 of the finishing profile 70, remains aligned and flush with the floor plane 200.

This solution is particularly advantageous since it allows to completely hide the bottom edge structure 11 in the floor 200.

This advantageous effect is maximized in case the flat finishing surface 71 comprises a graphical pattern equal to, or substantially equal to, a graphical pattern of a floor plane 200.

In a similar manner, also in the embodiment shown in FIG. 6, the bottom edge structure 11, while ensuring a safe mounting of the panels 101, 102, is, in use, hardly visible or not visible when the wall 1 is viewed frontally from one of the faces of the panels 101 or 102. In fact, since the first bottom channel 12 and the second bottom channel 13, have a channel side at least partially open towards the outside of said wall 1, on opposite parts with respect to the wall plane P-P, the only part of the bottom edge structure visible when the wall 1 is observed from a direction orthogonal to the wall plane P-P, is the first or the second outer longitudinal side 14, 15, which has a very reduced height.

According to an embodiment, shown in FIG. 6, the first gasket profile 17 and the second gasket profile 18 extend, along the first panel bottom edge 103 and along the second panel bottom edge 105, respectively, over a width orthogonal to the wall plane P-P not greater than the thickness S1 of said first panel 101, and than the thickness S2 of said second panel 102, respectively.

The first gasket profile 17 and the second gasket profile 18 may each comprise a longitudinal upper engagement protrusion 23, 24 adapted to be engaged in a corresponding longitudinal upper slot 125, 126 which enters into said first panel 101 and into said second panel 102 from said first panel bottom edge 103 and from said second panel bottom edge 105, respectively.

The first gasket profile 17 and the second gasket profile 18 may each comprise a longitudinal lower engagement protrusion 27, 28 adapted to be engaged in a corresponding longitudinal lower slot 31, 32 which enters into said movable profile 22 from the bottom of said first bottom channel 12 and of said second bottom channel 13, respectively.

In accordance with an embodiment, the longitudinal upper engagement protrusion 23, 24 and the longitudinal lower engagement protrusion 27, 28 of said first gasket profile 17 and of said second gasket profile 18, respectively, are aligned with each other parallel to the wall plane P-P.

The presence of the longitudinal protrusions which engage into respective seats in the bottom edge of the panels and/or in the bottom channels, ensures a stable and secure locking of the panels with respect to the movable profile 22.

In accordance with an embodiment, shown for example in FIG. 6, the first panel bottom edge 103 and the second panel bottom edge 105 may be tapered and may each define a central longitudinal surface 108, 109 orthogonal to the wall plane P-P and two longitudinal side surfaces 110, 111, 112, 113 inclined and arranged on opposite parts with respect to the central longitudinal surface 108, 109.

Furthermore, the first bottom channel 12 and the second bottom channel 13 may each define two inclined side flanks 113, 114, 115, 116 parallel to the two inclined longitudinal side surfaces 110, 111, 112, 113, respectively.

The first gasket profile 17 and the second gasket profile 18 may each comprise a flat central portion and two inclined side portions configured to be interposed between, and adhering to, said inclined side surfaces 110, 111, 112, 113 and said inclined side flanks 113, 114, 115, 116.

Such a configuration mainly has two advantages, of which a first advantage is given by the fact that the inclined side flanks 113, 114, 115, 116 form a sliding invitation to position the panel in the correct position thereof, and a second advantage is that of contributing to the stability of the panel mounting in the corresponding channel.

In accordance with an embodiment, for example shown in FIG. 6, the first outer longitudinal side 14 of said wall bottom edge structure 11 and the second outer longitudinal side 15 of said wall bottom edge structure 11, have a side width D measured parallel to the wall plane P-P and orthogonal to the first panel 103 and second panel 105 bottom edge, with a value which is lower than the first panel thickness S1 and than the second panel thickness S2, respectively.

Furthermore, as shown, for example, in FIG. 6, the first longitudinal side 14 and the second longitudinal side 15 may comprise a flat portion parallel to the wall plane P-P, of a width measured parallel to the wall plane P-P and orthogonal to the first panel 103 and second panel 105 bottom edge, very reduced with respect to the first panel thickness S1 and to the second panel thickness S2, respectively, preferably lower than ½ of the first panel thickness S1 and of the second panel thickness S2, respectively, even more preferably at about ⅙ of the first panel thickness S1 and of the second panel thickness S2, respectively.

According to such embodiment, the first longitudinal side 14 and the second longitudinal side may comprise a flat inclined portion, forming a beveled edge.

In accordance with an embodiment, for example shown in FIG. 5, the first panel bottom edge 103 and the second panel bottom edge 105 are substantially flat and orthogonal to the wall plane P-P.

The first bottom channel 12 and the second bottom channel 13 may, for example, define a bottom surface 33, 36, being flat and orthogonal to the wall plane P-P, an inner side abutment surface 34, 37 parallel to the wall plane P-P, an abutment surface 35, 38 extending from the bottom surface 33, 36 parallel to the inner side abutment surface 34, 37, over a height which is lower than the height of the inner side abutment surface from the bottom surface 33, 36 measured orthogonal to the bottom surface 33, 36.

According to an embodiment, for example shown in FIG. 5, the first gasket profile 17 and the second gasket profile 18 each comprise a substantially flat base portion 39, 42 and two opposite flat side portions 40, 41, 43, 44 extending orthogonally from said base portion 39, 4, along an inner surface 121, 123 and an outer surface 122, 124 of said first panel 101 and of said second panel 102, respectively.

In accordance with an embodiment, for example shown in FIG. 5, the first outer longitudinal side 14 and the second outer longitudinal side 15 are substantially flat, parallel to each other and parallel to the wall plane P-P.

Thereby, the first outer longitudinal side 14 and the second outer longitudinal side 15 may slide with respect to a seat obtained below the floor plane 200, allowing an adjustment of the position of the movable profile 22 with respect to the fixed profile 21, and therefore of the position of the wall 1.

Between such first outer longitudinal side 14, second outer longitudinal side 15, and the seat obtained below the floor plane 200, one or more layers of occlusion material may be interposed, for example, made of felt or brush-like, which allows to prevent dust or other foreign bodies to be channeled and deposited in the seat obtained below the floor plane.

In accordance with an embodiment, the adjusting means 16 for adjusting the position of the movable profile 22 with respect to the fixed profile 21 comprise a sliding coupling 16' according to an adjustment direction A between said movable profile 22 and said fixed profile 21, and adjustment screws 16" with a screw axis arranged parallel to said adjustment direction A.

In accordance with an embodiment, the upper edge structure 51 comprises an upper fixed profile 57, an upper movable profile 58, two side fixing profiles 61, 62 which may be removably fixed to corresponding two opposite sides 63, 64 of said upper movable profile 58, parallel to the wall plane P-P, to form said first upper channel 52 and said second upper channel 53, respectively.

In accordance with an embodiment, the sliding means 56 comprise a sliding coupling 16' according to the adjustment direction A between said movable profile 22 and said fixed profile 21.

In accordance with an embodiment, the upper edge structure 51 comprises two opposite finishing profiles 65, 66 which may be externally applied to said side fixing profiles 61, 62 so as to externally cover said side fixing profiles 61, 62.

According to another aspect of the invention, the aforesaid objects and advantages are achieved by a method for installing a modular paneled partition wall.

The method comprises the steps of providing a floor defining a floor plane 200, said floor comprising a floor channel entering into said floor from the floor plane 200, and defining a channel bottom surface 202 and two channel side surfaces 201 extending between said channel bottom surface 202 and said floor plane 200, and a step of providing a modular paneled partition wall 1 as described above.

The bottom edge structure 11 of the aforesaid wall comprises a finishing profile 70 interposed between the first bottom channel 12 and the second bottom channel 13, having a size such as to entirely cover said third side 19 between the first bottom channel 12 and the second bottom channel 13.

Furthermore, the finishing profile 70 has a flat finishing surface 71 exposed towards the inside of the wall 1, said flat finishing surface 71 being arranged orthogonal to the wall plane P-P and parallel to the movable profile axis L.

The method comprises a step of installing the fixed profile 21 on the channel bottom surface 202. For example, the fixed profile 21 may be fastened to the bottom of the channel 202.

The method further comprises a step of adjusting the position of the movable profile 22 with respect to the fixed profile 21 according to the adjustment direction A so as to position the flat finishing surface 71 aligned and flush with the floor plane 200.

In accordance with an embodiment of the method, the flat finishing surface 71 comprises a graphical pattern equal to, or substantially equal to, a graphical pattern of the floor plane 200.

Those skilled in the art, in order to satisfy contingent needs, may modify and adapt the embodiments of the device described above, and replace elements with other functionally equivalent, without departing from the scope of the following claims. Each of the features described as belonging to a possible embodiment may be achieved independently from the other embodiments described.

It should be noted that the Figures are not necessarily in scale.

All of the features described herein and/or any step of the method described herein may be combined in any combination, except combinations where at least some of such features are mutually exclusive.

The invention claimed is:

1. A modular paneled partition wall, defining a wall plane (P-P), the modular paneled partition wall comprising:

a first pane panel, parallel to the wall plane (P-P), defining a first panel bottom edge, an opposite first panel upper edge, and a first panel thickness;

a second pane panel, parallel to the wall plane (P-P), defining a second panel bottom edge, an opposite second panel upper edge, and a second panel thickness;

a wall bottom edge structure surrounding the first panel bottom edge and the second panel bottom edge, comprising a fixed profile adapted to be fixed to a floor, and a movable profile defining a movable profile axis (L), adapted to support said first pane panel and said second pane panel, wherein the movable profile is parallel to the fixed profile and slidably engaged with the fixed profile along a predetermined adjustment direction belonging to the wall plane (P-P), means for adjusting a position of the movable profile with respect to the fixed profile according to the predetermined adjustment direction, wherein the movable profile defines a first outer longitudinal side of said wall bottom edge structure at least partially parallel to the wall plane (P-P), an opposite second outer longitudinal side of said wall bottom edge structure at least partially parallel to the wall plane (P-P), a third side arranged between said first outer longitudinal side and said second outer longitudinal side, wherein said movable profile comprises a first bottom channel configured to accommodate said first panel bottom edge, and a second bottom channel configured to accommodate said second panel bottom edge, said first bottom channel and said second bottom channel entering into said movable profile from said third side and being parallel to the wall plane (P-P) and arranged close to said first outer longitudinal side and said second outer longitudinal side, respectively; and a wall upper edge structure arranged along the wall plane (P-P), comprising a first upper channel configured to accommodate said first panel upper edge, and a second upper channel configured to accommodate said second panel upper edge, said first upper channel and said second upper channel being parallel to the wall plane (P-P), said wall upper edge structure comprising sliding means to allow an adjustment of said first panel upper edge and said second panel upper edge, according to said predetermined adjustment direction;

wherein said modular paneled partition wall comprises:

a first aluminum gasket profile interposed between said first bottom channel and said first panel bottom edge; and a second aluminum gasket profile interposed between said second bottom channel and said second panel bottom edge;

wherein the first aluminum gasket profile and the second aluminum gasket profile extend along the first panel bottom edge and along the second panel bottom edge, respectively, over a width measured orthogonal to the wall plane (P-P) no greater than the first panel thickness and the second panel thickness, respectively;

wherein the first aluminum gasket profile and the second aluminum gasket profile each comprise a longitudinal lower engagement protrusion adapted to be engaged in a corresponding longitudinal lower slot which enters into said movable profile from the bottom of said first bottom channel and of said second bottom channel, respectively; and wherein the longitudinal upper engagement protrusion and the longitudinal lower engagement protrusion of said first aluminum gasket profile and of said second aluminum gasket profile, respectively, are aligned with each other parallel to the wall plane (P-P).

2. The modular paneled partition wall of claim 1, wherein the first aluminum gasket profile is shaped to adhere both to the first panel bottom edge and to the first bottom channel, and wherein the second aluminum gasket profile is shaped to adhere both to the second panel bottom edge and to the second bottom channel.

3. The modular paneled partition wall of claim 1, wherein each of said first bottom channel and said second bottom channel has a channel side at least partially open towards an outside of said modular paneled partition wall, on parts opposing the wall plane (P-P).

4. The modular paneled partition wall of claim 1, wherein the first aluminum gasket profile and the second aluminum gasket profile each comprise a longitudinal upper engagement protrusion adapted to be engaged in a corresponding longitudinal upper slot which enters into said first pane panel and into said second pane panel from said first panel bottom edge and from said second panel bottom edge, respectively.

5. The modular paneled partition wall of claim 1, wherein:

the first panel bottom edge and the second panel bottom edge are tapered and each defines a central longitudinal surface orthogonal to the wall plane (P-P) and two inclined longitudinal side surfaces arranged on opposite parts with respect to the central longitudinal surface;

the first bottom channel and the second bottom channel each define two inclined side flanks parallel to the two inclined longitudinal side surfaces, respectively;

the first aluminum gasket profile and the second aluminum gasket profile each comprise a flat central portion and two inclined side portions configured to be interposed between, and adhering to, said inclined side surfaces and said inclined side flanks.

6. The modular paneled partition wall of claim 1, wherein the first outer longitudinal side of said wall bottom edge structure and the second outer longitudinal side of said wall bottom edge structure, have a side width measured parallel to the wall plane (P-P) and orthogonal to the first panel bottom edge and the second panel bottom edge lower than the first panel thickness and the second panel thickness, respectively.

7. The modular paneled partition wall of claim 1, wherein the first panel bottom edge and the second panel bottom edge are flat and orthogonal to the wall plane (P-P).

8. The modular paneled partition wall of claim 7, wherein the first bottom channel and the second bottom channel define a bottom surface, being flat and orthogonal to the wall plane (P-P), an inner side abutment surface parallel to the wall plane (P-P), an abutment surface extending from the bottom surface parallel to the inner side abutment surface, over a height lower than the height of the inner side abutment surface from the bottom surface measured orthogonal to the bottom surface.

9. The modular paneled partition wall of claim 8, wherein the first aluminum gasket profile and the second aluminum gasket profile each comprise a flat base portion and two opposite flat side portions extending orthogonally from said flat base portion, along an inner surface and an outer surface of said first pane panel and of said second pane panel, respectively.

10. The modular paneled partition wall of claim 1, wherein the first outer longitudinal side and the second outer longitudinal side are flat, parallel to each other and parallel to the wall plane (P-P).

11. The modular paneled partition wall of claim 1, wherein the wall bottom edge structure comprises a finishing profile interposed between the first bottom channel and the second bottom channel, having a size to entirely cover said third side between the first bottom channel and the second bottom channel.

12. The modular paneled partition wall of claim 11, wherein the finishing profile has a flat finishing surface exposed towards an inside of the modular paneled partition wall, said flat finishing surface being arranged orthogonal to the wall plane (P-P) and parallel to the movable profile axis (L).

13. The modular paneled partition wall of claim 1, wherein one of, or both, the first pane panel and the second pane panel are made of glass, marble, stone, or another fragile material.

14. A method for installing a modular paneled partition wall, the method comprising:

providing a floor defining a floor plane, said floor comprising a floor channel entering into said floor from the floor plane, and defining a channel bottom surface and two channel side surfaces extending between said channel bottom surface and said floor plane;

providing a modular paneled partition wall, defining a wall plane (P-P), the modular paneled partition wall comprising:

a first pane panel, parallel to the wall plane (P-P), defining a first panel bottom edge, an opposite first panel upper edge, and a first panel thickness;

a second pane panel, parallel to the wall plane (P-P), defining a second panel bottom edge, an opposite second panel upper edge, and a second panel thickness;

a wall bottom edge structure surrounding the first panel bottom edge and the second panel bottom edge, comprising a fixed profile adapted to be fixed to a floor, and a movable profile defining a movable profile axis (L), adapted to support said first pane panel and said second pane panel, wherein the movable profile is parallel to the fixed profile and slidably engaged with the fixed profile along a predetermined adjustment direction belonging to the wall plane (P-P), means for adjusting a position of the movable profile with respect to the fixed profile according to the predetermined adjustment direction, wherein the movable profile defines a first outer longitudinal side of said wall bottom edge structure at least partially parallel to the wall plane (P-P), an opposite second outer longitudinal side of said wall bottom edge structure at least partially parallel to the wall plane (P-P), a third side arranged between said first outer longitudinal side and said second outer longitudinal side, wherein said movable profile comprises a first bottom channel configured to accommodate said first panel bottom edge, and a second bottom channel configured to accommodate said second panel bottom edge, said first bottom channel and said second bottom channel entering into said movable profile from said third side and being parallel to the wall plane (P-P) and arranged close to said first outer longitudinal side and said second outer longitudinal side, respectively; and a wall upper edge structure arranged along the wall plane (P-P), comprising a first upper channel configured to accommodate said first panel upper edge, and a second upper channel configured to accommodate said second panel upper edge, said first upper channel and said second upper channel being parallel to the wall plane (P-P), said wall upper edge structure comprising sliding means to allow an adjustment of said first panel upper edge and said second panel upper edge, according to said predetermined adjustment direction;

wherein said modular paneled partition wall further comprises:

a first aluminum gasket profile interposed between said first bottom channel and said first panel bottom edge; and a second aluminum gasket profile interposed between said second bottom channel and said second panel bottom edge;

wherein the first aluminum gasket profile and the second aluminum gasket profile extend along the first panel bottom edge and along the second panel bottom edge, respectively, over a width measured orthogonal to the wall plane (P-P) no greater than the first panel thickness and the second panel thickness, respectively;

wherein the first aluminum gasket profile and the second aluminum gasket profile each comprise a longitudinal lower engagement protrusion adapted to be engaged in a corresponding longitudinal lower slot which enters into said movable profile from the bottom of said first bottom channel and of said second bottom channel, respectively; and wherein the longitudinal upper engagement protrusion and the longitudinal lower engagement protrusion of said first aluminum gasket profile and of said second aluminum gasket profile, respectively, are aligned with each other parallel to the wall plane (P-P), wherein the wall bottom edge structure comprises a finishing profile interposed between the first bottom channel and the second bottom channel, having a size to entirely cover said third side between the first bottom channel and the second bottom channel, wherein the finishing profile has a flat finishing surface exposed towards an inside of the modular paneled partition wall, said flat finishing surface being arranged orthogonal to the wall plane (P-P) and parallel to the movable profile axis (L);

installing the fixed profile on said channel bottom surface; and adjusting the position of the movable profile with respect to the fixed profile according to the adjustment direction so as to position the flat finishing surface aligned and flush with the floor plane.

15. The method of claim 14, wherein the flat finishing surface comprises a graphical pattern equal to a graphical pattern of the floor plane.

* * * * *